US008456270B2

(12) United States Patent
Davis et al.

(10) Patent No.: US 8,456,270 B2
(45) Date of Patent: Jun. 4, 2013

(54) THERMALLY ACTUATED MULTIPLE OUTPUT THERMAL SWITCH DEVICE

(75) Inventors: George D. Davis, Bellevue, WA (US); John F. Ehret, Sammamish, WA (US)

(73) Assignee: Honeywell International Inc., Morristown, NJ (US)

( * ) Notice: Subject to any disclaimer, the term of this patent is extended or adjusted under 35 U.S.C. 154(b) by 298 days.

(21) Appl. No.: 12/971,410

(22) Filed: Dec. 17, 2010

(65) Prior Publication Data

US 2012/0154103 A1 Jun. 21, 2012

(51) Int. Cl.
*H01H 37/52* (2006.01)

(52) U.S. Cl.
USPC ..... 337/338; 337/334; 337/335; 337/336; 337/337; 337/380; 337/381

(58) Field of Classification Search
USPC ..... 337/334–338, 380, 381
See application file for complete search history.

(56) References Cited

U.S. PATENT DOCUMENTS

| | | | | |
|---|---|---|---|---|
| 2,792,473 | A * | 5/1957 | Hawke | 337/361 |
| 3,493,911 | A * | 2/1970 | Broetto | 337/354 |
| 3,893,057 | A | 7/1975 | Beunk et al. | |
| 4,027,385 | A | 6/1977 | Deubel | |
| 4,339,740 | A * | 7/1982 | Greenhalgh | 337/39 |
| 4,970,485 | A | 11/1990 | Wahls | |
| 5,043,690 | A | 8/1991 | Wahls | |
| 6,762,668 | B2 * | 7/2004 | Davis et al. | 337/111 |
| 6,781,504 | B2 * | 8/2004 | Scott et al. | 337/380 |
| 6,836,205 | B2 | 12/2004 | Scott et al. | |
| 6,891,464 | B2 * | 5/2005 | Scott et al. | 337/343 |
| 7,071,809 | B2 | 7/2006 | Davis | |
| 7,358,740 | B2 | 4/2008 | Davis et al. | |
| 7,663,467 | B2 * | 2/2010 | Hsu | 337/336 |
| 2003/0034872 | A1 * | 2/2003 | Scott et al. | 337/380 |
| 2004/0045361 | A1 * | 3/2004 | Davis et al. | 73/763 |
| 2008/0169897 | A1 * | 7/2008 | Yang | 337/335 |

FOREIGN PATENT DOCUMENTS

| | | |
|---|---|---|
| GB | 1472435 | 5/1977 |
| GB | 2071913 A * | 9/1981 |

OTHER PUBLICATIONS

European Patent Office, "European Search Report", mailed Mar. 30, 2012, Published in: EP.
European Patent Office, "Office Action", "from Foreign Counterpart of U.S. Appl. No. 12/971,410", May 24, 2012, Published in: EP.

* cited by examiner

*Primary Examiner* — Anatoly Vortman
(74) *Attorney, Agent, or Firm* — Fogg & Powers LLC

(57) ABSTRACT

A multiple output thermal switch device comprises a first switch unit having upper and lower surfaces, and a second switch unit having upper and lower surfaces. A plurality of terminal posts partially protrude from the upper surfaces of the first and second switch units. A locating plate supports the first and second switch units, with the locating plate having a top wall and a side wall that define a chamber. First and second actuator buttons protrude from the lower surfaces of the first and second switch units. A bimetallic plate is disposed in the chamber and is configured to contact the first and second actuator buttons when a predetermined temperature is reached. A case surrounds the first and second switch units, and the locating plate. The case has a bottom wall with a temperature sensing surface. The thermal switch device is selectable such that two set points are obtainable from a single snap-action of the bimetallic plate toward the first and second actuator buttons.

20 Claims, 2 Drawing Sheets

THERMALLY ACTUATED MULTIPLE OUTPUT THERMAL SWITCH DEVICE

BACKGROUND

Conventional switches are mainly single-pole single-throw devices. Should a circuit require multiple actions as a result of the switch actuation, a relay is typically used. For example, current thermal switch devices are thermally actuated for a high and low set point, an on/off switch, or a single-pole single-throw. The thermal switch controls the temperature close and open set points and a relay must be used to split the signal when required. This reduces reliability by requiring a second device to split the signal. In addition, material cost is increased by use of the relay, and labor is increased due to additional wiring and installation costs. Also, footprint is increased by the size and mounting for the relay, and weight is increased by the need for the relay.

SUMMARY

A multiple output thermal switch device comprises a first switch unit having an upper surface and a lower surface, and a second switch unit having an upper surface and a lower surface. A plurality of terminal posts partially protrude from the upper surface of the first switch unit, and a plurality of terminal posts partially protrude from the upper surface of the second switch unit. A locating plate supports the first switch unit and the second switch unit, with the locating plate having a top wall and a side wall that define a chamber. A first actuator button protrudes from the lower surface of the first switch unit, and a second actuator button protrudes from the lower surface of the second switch unit. A bimetallic plate is disposed in the chamber under the first and second actuator buttons, with the bimetallic plate configured to contact the first and second actuator buttons when a predetermined temperature is reached. A case surrounds the first and second switch units, and the locating plate. The case has a bottom wall with a temperature sensing surface. The thermal switch device is selectable such that two set points are obtainable from a single snap-action of the bimetallic plate toward the first and second actuator buttons.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

Figure 1A:
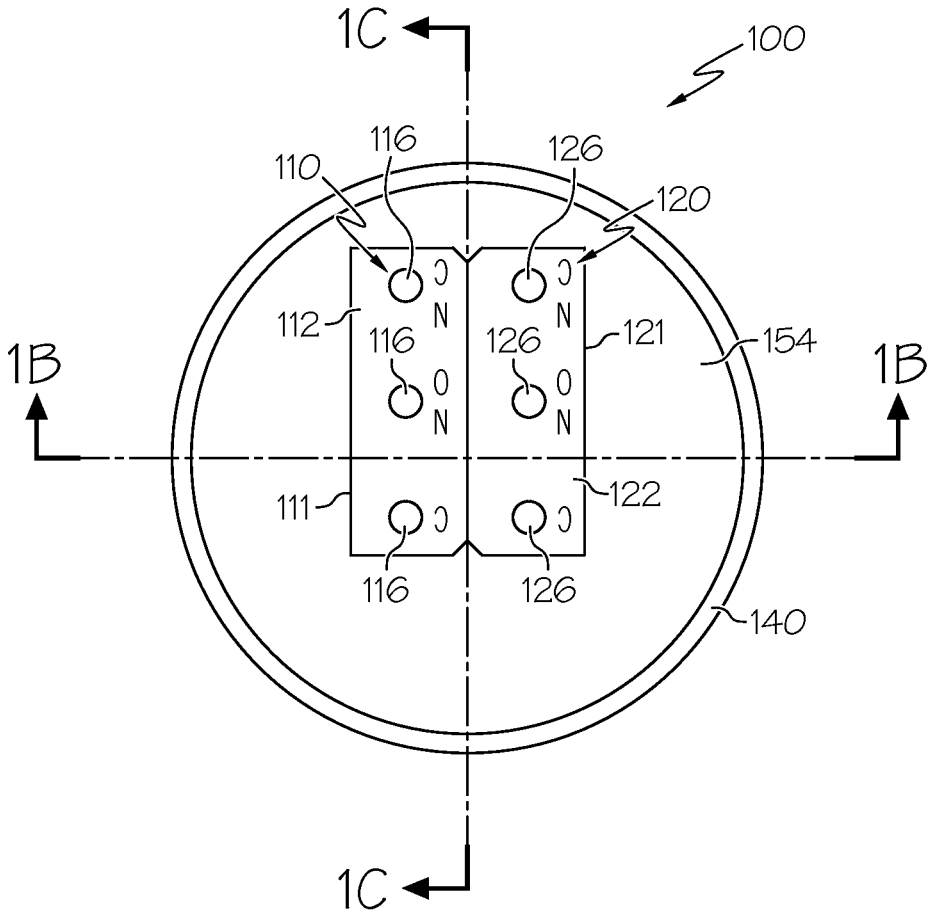
FIG. 1A is a top plan view of a thermally actuated, multiple output, thermal switch device according to one embodiment.

In the following detailed description, while reference is made to the accompanying drawings in which is shown, by way of illustration, exemplary embodiments, it is to be understood that other embodiments may be utilized. The following detailed description is, therefore, not to be taken in a limiting sense.

A thermally actuated, multiple output thermal switch device is provided in which the function of a pair of micro-switches is caused by thermal actuation. The present thermal switch device splits a signal without use of a relay, thereby reducing labor, space, weight, cost, as well as increasing reliability. The thermal switch device also provides redundancy of circuit in one device, and can change switch operating direction on any circuit from close to open and/or open to close. The thermal switch device is also thermally actuated for a high and/or low set point. The set point can be made to have two set points on high or low by changing the orientation of the micro-switches relative to a sensing element such as a snap-action bimetallic sensing disc, thereby creating two different temperature outputs with one actuation.

In addition, the thermal switch device is selectable such that two set points may be obtained from a single snap-action of the sensing element surface toward an actuator button on each micro-switch. For example, by rotating the micro-switches such that both actuator buttons strike the sensing disc off center, set points can be simultaneously attained that are about 4° F. different from a single snap-action toward actuator buttons that are not off center. Other configurations of the micro-switches will yield different actuator button offsets, such as one button at the disc center and one button at the disc edge.

The present thermal switch device can be configured to perform the following switching functions: Single-Pole Single-Throw (SPST), Single-Pole Double-Throw (SPDT), SPST+SPST, SPDT+SPST, SPDT+SPDT, and Double-Pole Double-Throw (DPDT). For example, one micro-switch in the thermal switch device may be wired to thermally actuate an SPST mechanism, and the other micro-switch may be wired to thermally actuate an SPDT mechanism. This configuration allows for thermal management of close-close and close-open with one switch at one, two, three, or four set points, including an upper set point and a lower set point.

When the present thermal switch device is wired to thermally actuate two SPDT mechanisms, the following capabilities are provided: dual electrical redundancy from two SPST switches for an upper set point; and dual electrical redundancy from two SPST switches for a lower set point. This redundancy allows for extended operating life for the upper and/or lower set points by splitting the work between the two SPDT mechanisms. The redundancy also provides for increased reliability from one thermal switch device, while dropping the need for a relay. In addition, the use of two SPDT mechanisms provides for a DPDT functionality that is thermally actuated at an upper and/or lower set point.

The present thermal switch device is also a thermally actuated polarity/phase reversal device. The thermal switch device provides for reversing close and open set points in any combination.

Further details with respect to the present thermal switch device are described as follows with reference to the drawings.

Figure 1B:
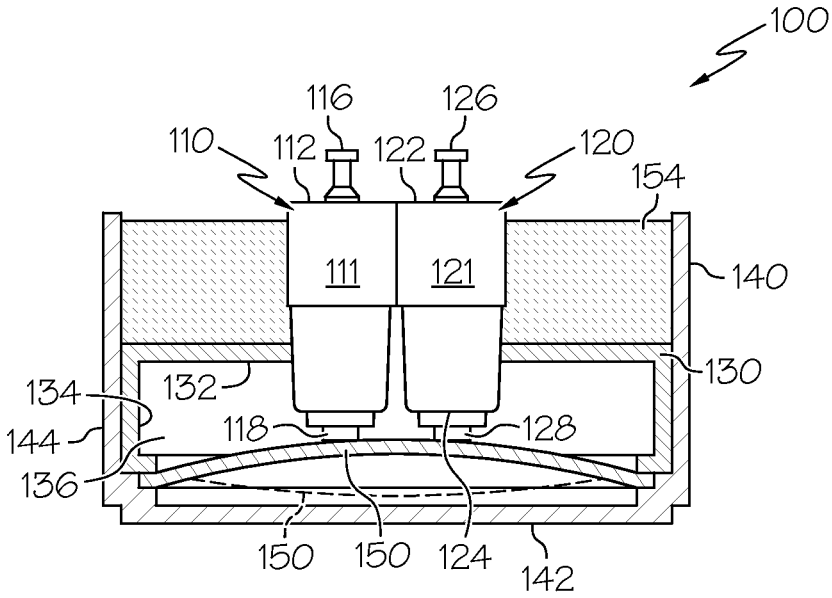
FIG. 1B is a cross-sectional end view of the thermal switch device of FIG. 1A.
Figure 1C:
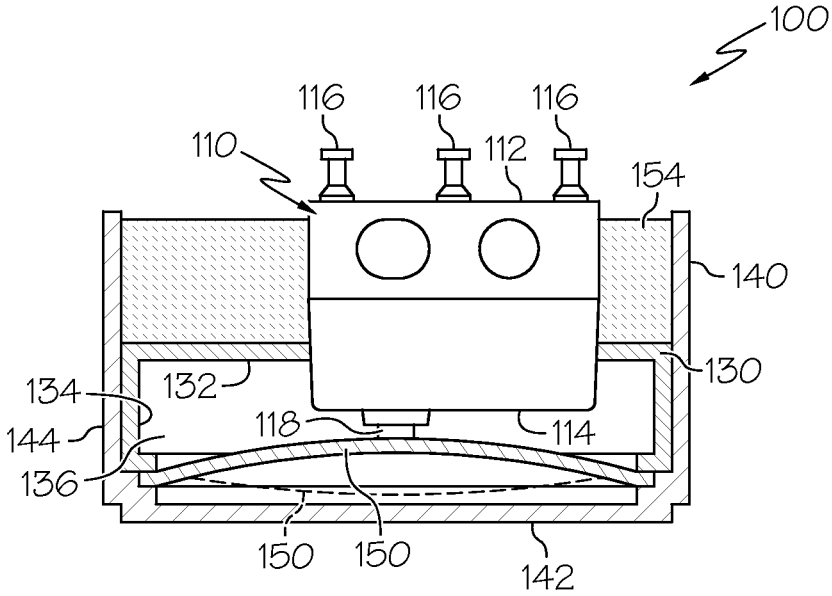
FIG. 1C is a cross-sectional side view of the thermal switch device of FIG. 1A.

FIGS. 1A-1C illustrates a dual thermal switch device 100 according to one embodiment. The thermal switch device 100 generally includes a first switch unit 110 having a housing 111 with an upper surface 112 and a lower surface 114. The thermal switch device 100 also includes a second switch unit 120 having a housing 121 with an upper surface 122 and a lower surface 124. In one embodiment, the switch units 110 and 120 are micro-switches.

The switch unit 110 has a plurality of terminal posts 116 mounted in housing 111 and protruding from upper surface 112. Likewise, switch unit 120 has a plurality of terminal posts 126 mounted in housing 121 and protruding from upper surface 122. The switch units 110 and 120 are positioned in a contiguous relationship such that terminal posts 116 and 126 are substantially parallel to each other. In addition, switch unit 110 has an actuator button 118 protruding from housing 111 at lower surface 114, and switch unit 120 has an actuator button 128 protruding from housing 121 at lower surface 124.

As shown in FIG. 1A, in one embodiment, switch units 110 and 120 each have three terminals, so that thermal switch device 100 has a total of six terminals. The six terminals can be wired in various configurations to perform the switching functions described previously.

An electrical temperature sensor (not shown) can be located in housing 111 of switch unit 110, and electrically connected to terminal posts 116. Likewise, an electrical temperature sensor (not shown) can be located in housing 121 of switch unit 120, and electrically connected to terminal posts 126. The temperature sensor can be implemented as a resistance thermal device, a thermistor, a thermocouple, or the like.

Further details related to implementing an electrical temperature sensor in a thermal switch device is disclosed in U.S. Pat. No. 6,836,205, the disclosure of which is incorporated herein by reference.

Electrical contacts are mounted on the ends of terminal posts 116 in housing 111 of switch unit 110. Likewise, electrical contacts are mounted on the ends of terminal posts 126 in housing 121 of switch unit 120. The electrical contacts are moveable relative to one another between an open and a closed state. In one embodiment, the electrical contacts are biased together in a closed state. The actuator buttons 118 and 128 are coupled with the electrical contacts such that when engaged, the actuator buttons separate the contacts to form an open state.

As depicted in FIGS. 1B and 1C, a locating plate 130 supports first switch 110 and second switch 120 in a desired position. The locating plate 130 has a top wall 132 and a side wall 134 that define a chamber 136. The top wall 132 defines an aperture through which a lower portion of switch units 110, 120 extends such that actuator buttons 118 and 128 are located in chamber 136.

A case 140 such as a metallic cylindrical case surrounds first and second switch units 110, 120 and locating plate 130. The case 140 has a bottom wall 142 positioned under top wall 132 of locating plate 130, and a side wall 144 in intimate contact with side wall 134 of locating plate 130. The bottom wall 142 has a temperature sensing surface and seals chamber 136.

A bimetallic plate 150 such as a snap-action bimetallic disc is disposed in chamber 136 under actuator buttons 118 and 128. A peripheral edge portion of bimetallic plate 150 is mounted on an annular step around the interior of case 140 and is spaced above bottom wall 142 of case 140. A lower annular lip protrudes from side wall 134 of locating plate 130 and captures the peripheral edge portion of bimetallic plate 150 such that bimetallic plate 150 can flex to contact actuator buttons 118 and 128 during operation of thermal switch device 100.

The bimetallic plate 150 inverts with a snap-action as a function of a predetermined temperature between two bistable oppositely concave and convex states. In a first state, the bimetallic plate is convex and contacts the actuator buttons 118 and 128, as shown in FIGS. 1B and 1C, such that an open circuit is formed in switch units 110 and 120 when the electrical contacts are separated from each other. In a second state, the bimetallic plate is concave and does not contact actuator buttons 118 and 128 such that a closed circuit is formed in switch units 110 and 120 as the electrical contacts are biased together.

An epoxy potting material 154 surrounds switch units 110, 120 in an upper section of thermal switch device 100 above top wall 132 of locating plate 130. The epoxy potting material 154 holds switch units 110, 120 in an immovable position in thermal switch device 100, and provides environmental sealing for the switch units. Alternatively, switch device 100 can be fabricated with a hermetic seal by using external packaging, or hermetically sealed micro-switches.

Although specific embodiments have been illustrated and described herein, it will be appreciated by those of ordinary skill in the art that any arrangement, which is calculated to achieve the same purpose, may be substituted for the specific embodiments shown. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope.

What is claimed is:

1. A multiple output thermal switch device, comprising:

a first switch unit having an upper surface and a lower surface;

a second switch unit having an upper surface and a lower surface;

a plurality of terminal posts that partially protrude from the upper surface of the first switch unit;

a plurality of terminal posts that partially protrude from the upper surface of the second switch unit;

a locating plate that supports the first switch unit and the second switch unit, the locating plate having a top wall and a side wall that define a chamber;

a first actuator button protruding from the lower surface of the first switch unit;

a second actuator button protruding from the lower surface of the second switch unit;

a bimetallic plate disposed in the chamber under the first and second actuator buttons, the bimetallic plate configured to contact the first and second actuator buttons when a predetermined temperature is reached; and a case surrounding the first and second switch units, and the locating plate, the case having a bottom wall with a temperature sensing surface;

wherein at least one of the first and second actuator buttons is positioned to contact the bimetallic plate off center such that two temperature set points are generated from a single snap-action of the bimetallic plate toward the first and second actuator buttons.

2. The thermal switch device of claim 1, wherein the plurality of terminal posts on the first and second switch units are substantially parallel to each other.

3. The thermal switch device of claim 1, wherein the first and second switch units each have three terminal posts.

4. The thermal switch device of claim 1, wherein the switch device is configurable as a single-pole single-throw switch, a single-pole double-throw switch, or two single-pole single-throw switches.

5. The thermal switch device of claim 1, wherein the switch device is configurable as both a single-pole double-throw switch and a single-pole single-throw switch.

6. The thermal switch device of claim 1, wherein the switch device is configurable as two single-pole double-throw switches, or a double-pole double-throw switch.

7. The thermal switch device of claim 1, wherein the first and second actuator buttons are located inside the chamber.

8. The thermal switch device of claim 1, further comprising an epoxy potting material that surrounds at least a portion of the first and second switch units.

9. The thermal switch device of claim 1, wherein the case is a metallic cylindrical case.

10. The thermal switch device of claim 1, wherein the first switch unit comprises a micro-switch.

11. The thermal switch device of claim 1, wherein the second switch unit comprises a micro-switch.

12. The thermal switch device of claim 1, wherein both the first and second actuator buttons are positioned to contact the bimetallic plate off center.

13. A multiple output thermal switch device, comprising:

a first switch unit having an upper surface and a lower surface;

a second switch unit having an upper surface and a lower surface;

three terminal posts that partially protrude from the upper surface of the first switch unit;

three terminal posts that partially protrude from the upper surface of the second switch unit;

a locating plate that supports the first and second switch units such that the respective terminal posts on the first and second switch units are substantially parallel to each other, the locating plate having a top wall and a side wall that define a chamber;

a first actuator button protruding into the chamber from the lower surface of the first switch unit;

a second actuator button protruding into the chamber from the lower surface of the second switch unit;

a bimetallic disc disposed in the chamber under the first and second actuator buttons, the bimetallic disc configured to contact the first and second actuator buttons when a predetermined temperature is reached; and a metallic cylindrical case surrounding the first and second switch units, and the locating plate, the cylindrical case having a bottom wall with a temperature sensing surface;

wherein at least one of the first and second actuator buttons is positioned to contact the bimetallic disc off center such that two temperature set points are generated from a single snap-action of the bimetallic disc toward the first and second actuator buttons.

14. The thermal switch device of claim 13, wherein the switch device is configurable as a single-pole single-throw switch, a single-pole double-throw switch, or two single-pole single-throw switches.

15. The thermal switch device of claim 13, wherein the switch device is configurable as both a single-pole double-throw switch and a single-pole single-throw switch.

16. The thermal switch device of claim 13, wherein the switch device is configurable as both a single-pole double-throw switch and a single-pole single-throw switch.

17. The thermal switch device of claim 13, wherein the switch device is configurable as two single-pole double-throw switches, or a double-pole double-throw switch.

18. The thermal switch device of claim 13, further comprising an epoxy potting material that surrounds at least a portion of the first and second switch units.

19. The thermal switch device of claim 13, wherein the first switch unit comprises a micro-switch.

20. The thermal switch device of claim 13, wherein the second switch unit comprises a micro-switch.

* * * * *